US005374234A

United States Patent [19]

Madsen

[11] Patent Number: 5,374,234

[45] Date of Patent: Dec. 20, 1994

[54] DECANTER CENTRIFUGE WITH ENERGY DISSIPATING INLET

[75] Inventor: Bent Madsen, Gentofte, Denmark

[73] Assignee: Alfa-Laval Separation A/S, Soborg, Denmark

[21] Appl. No.: 193,649

[22] Filed: Feb. 7, 1994

Related U.S. Application Data

[63] Continuation of Ser. No. 920,545, Aug. 20, 1992, abandoned.

[30] Foreign Application Priority Data

Mar. 13, 1990 [DK] Denmark ..... 651/90

[51] Int. Cl.[5] ..... B04B 1/20

[52] U.S. Cl. ..... 494/53

[58] Field of Search ..... 494/43, 52–55, 494/67, 85; 210/377, 380.1, 380.3

[56] References Cited

U.S. PATENT DOCUMENTS

| | | | |
|---|---|---|---|
| 2,435,623 | 2/1948 | Forsberg | 494/53 X |
| 2,703,676 | 3/1955 | Gooch | 494/53 X |
| 3,143,504 | 4/1964 | Schneider . | |
| 3,228,592 | 1/1966 | Shapiro | 494/53 X |
| 3,428,246 | 2/1969 | Finkelston . | |
| 3,967,778 | 7/1976 | Hunwick | 494/53 X |
| 4,334,647 | 6/1982 | Taylor | 494/53 X |

FOREIGN PATENT DOCUMENTS

| | | | |
|---|---|---|---|
| 0177838 | 4/1986 | European Pat. Off. . | |
| 1221247 | 5/1960 | France | 210/377 |
| 2057600 | 5/1971 | France . | |
| 1119173 | 12/1961 | Germany . | |
| 63-194759 | 8/1988 | Japan | 494/53 |
| 1025079 | 4/1966 | United Kingdom . | |
| 1457416 | 12/1976 | United Kingdom | 494/53 |
| 1613174 | 12/1940 | U.S.S.R. | 494/53 |
| 561574 | 6/1977 | U.S.S.R. | 494/53 |
| 862994 | 9/1981 | U.S.S.R. | 494/53 |

*Primary Examiner*—David A. Scherbel
*Assistant Examiner*—Charles Cooley
*Attorney, Agent, or Firm*—Wagner, Cantor, Mueller & Player

[57] ABSTRACT

A decanter centrifuge comprises a drum (1) with a conveyor (2) containing an inlet (4). The liquid to be separated flows in a jet centrally into the inlet (4) towards an end wall (11), at which the liquid is radially distributed and flows axially onwards towards the second end wall (13) through an area of the inlet (4) free of members imparting an angular velocity to the liquid. The inlet (4) is provided with inlet apertures (6) positioned on a radius larger than the radius to the overflow edge (9) at the liquid discharge. The design of the inlet (4) implies that the free liquid surface in the inlet during operation is drawn far towards the axis of the drum, thereby causing excess energy supplied to the liquid during acceleration to the angular velocity of the conveyor (2) to be dissipated in the comparatively thick liquid layer before the liquid discharges into the separation space (7) through the inlet apertures (6).

12 Claims, 7 Drawing Sheets

DECANTER CENTRIFUGE WITH ENERGY DISSIPATING INLET

CROSS-REFERENCE TO RELATED APPLICATION

This application is a continuation of U.S. application Ser. No. 07/920,545, filed Aug. 20, 1992, now abandoned.

BACKGROUND OF THE INVENTION

The invention relates to a decanter centrifuge comprising a rotatably journalled drum having at one end outlet openings for the separated liquid phase, and a conveyor rotatably journalled in the drum with a conveyor body containing an inlet in the form of a cavity for the feed to be separated, said inlet being radially defined by a wall coaxial with the conveyor body and provided with inlet apertures located between two adjacent flights of the conveyor and connecting the inlet with the space between the conveyor body and the internal side of the drum, the inlet being axially defined by a rotationally symmetrical first end wall and a second end wall located opposite the first end wall, said second end wall having a central projection extending towards the first end wall and containing an axial bore for an inlet pipe for the feed, said inlet pipe being coaxial with the drum, and having a mouth facing the inlet and being located in the plane perpendicular to the axis of the drum.

In decanter centrifuges of this type, it is a problem that the feed during acceleration to the angular velocity of the conveyor body receives twice as much energy as necessary for the liquid to form a liquid layer along the internal side of the inlet. The excess energy results in undesirable turbulent flows in the liquid extending from the inlet into the space between the conveyor body and the internal side of the drum where the energy is finally converted to heat.

The circumstance that excess energy is supplied to the liquid will be recognized by studying a unit volume of liquid present at the internal liquid surface of the inlet. This volume will have a kinetic energy given by $$\tfrac{1}{2}\rho\omega^2 r^2,$$

wherein $\omega$ is the angular velocity of the conveyor body, and $r$ is radius to the overflow edge. The angular momentum L of the liquid volume about the axis of rotation is $$\rho\omega r^2.$$

This angular momentum results from the influence of the inlet which rotates with the angular velocity $\omega$. The energy supplied from the motor propelling the decanter centrifuge is thus $$L\omega=\rho\omega^2 r^2.$$

It will be seen that this energy is twice as large as the above stated energy that was necessary to keep the liquid volume in the free surface.

This excess energy cannot be deposited in the liquid or dissipated without giving rise to interfering liquid flows in the comparatively thin liquid layer on the internal side of the inlet, thereby decreasing the efficiency of the separation process.

U.S. Pat. No. 3,428,246 describes a decanter centrifuge of the above type where accumulation of solids in the inlet and resulting erosion of the inlet pipe is avoided by means of radial ribs on the first end wall in the peripheral area at the inlet openings, a second end wall shaped as an inclined baffleplate, a deflecter assembly on the inlet pipe and the projection on the second end wall, and outlet openings for the separated liquid located at a radius which is greater than the radius to the inlet openings.

EP patent application No. 0.177.838 describes a decanter centrifuge in which a flocculant is added to the feed in the area between the first end wall and the outlet openings. The flocculant is supplied under pressure through a nozzle and the feed flow is partly penetrated by the flocculant. The feed flow shown in the drawing, indicates that the outlet openings for the separated liquid is located radially further cut than the inlet openings in the inlet.

In a centrifuge described in FR patent No. 2.057.600 the outlet openings for the liquid phase are located radially inwards of the inlet openings, such that the liquid phase partially fills the inlet. The purpose is to effect separation of the solids within the inlet. In this centrifuge the second end wall is reduced to a set of spokes carrying one end of the tubular conveyor body, in order to permit the liquid phase to escape from the inlet directly to the outlet openings.

SUMMARY OF THE INVENTION

It is a main object of the invention to provide a decanter centrifuge having an inlet in which said excess energy may be dissipated before the feed flows through the inlet apertures and discharges into the space between the conveyor body and the internal side of the drum where the separation of the solid constituents is effected.

It is a further aim of the invention to demonstrate how the inlet of the decanter centrifuge may be shaped in order to regulate the flow therein to various rates of flow or different types of feed.

The decanter centrifuge according to the invention differs from the prior art in that the mouths of the inlet apertures in the inlet are located on a radius greater than the radius to the outlet openings, that a peripheral area of the inlet outwardly defined by the radius to the inlet apertures is free of carriers, inwardly extending projections or the like, that the second end wall is rotationally symmetrical and that the projection of the second end wall has the shape of a truncated cone whose pointed end faces the first end wall.

The feed flowing through the inlet pipe is led as a jet directly towards the first end wall where it divides and flows towards the radially confining wall of the inlet. As the wall includes no members contributing to rotating the feed, merely a torque is transferred to the feed determined by the friction between the feed and the internal side of the end wall. The angular velocity of the feed in the inlet may therefore be kept substantially lower than the angular velocity of the conveyor body. The free liquid surface in the inlet will therefore be positioned on a considerably smaller radius than the radius to the outlet openings.

It is then obtained that the flow in the inlet, when the decanter centrifuge has attained its normal operating condition, mainly passes in the direction from the first end wall and parallel to the free surface in the inlet towards the second end wall and a uniform outflow is concurrently effected through the inlet apertures. When the feed approaches the inlet apertures it has by and large attained the same angular velocity as the conveyor body, but due to the comparatively long path of flow in the thick liquid layer in the inlet, the excess energy has been disspipated in a manner as to prevent the occurrence of turbulent flows which are entrained through the inlet apertures into the space between the conveyor body and the internal side of the drum.

By shaping the projection of the second end wall as a truncated cone whose pointed end faces the first end wall any air occurring in the feed or being entrained by the feed while flowing into the inlet may be passed away along the periphery of the projection of the second end wall, thereby preventing an air cushion from occurring in the inlet which may interfere with the intended flow. With the stated design of the projection any liberated air will flow along the periphery of the projection and leave the inlet through the axial bore in the projection.

In preferred embodiments of the invention the projection of the second end wall may have substantially radial, longitudinal ribs uniformly distributed along the periphery of the projection, or there may be one or more substantially radial ribs following helices along the periphery of the projection. A larger momentum is thus transferred to the liquid in the inlet in case the free liquid surface approaches the periphery of the projection, e.g. because the rate of flow of the feed increases. By altering the shape of the ribs, e.g. from rectilinear ribs to ribs twisting several times round the projection following a helix, the flow may be directed more strongly towards the second end wall, thereby obtaining an improved axial distribution of the feed, and by altering the radial extension of the ribs it is possible to ensure that the free surface of the liquid does not approach such a small radius that the liquid may discharge through the bore of the inlet pipe in the projection.

An alternative preferred embodiment is characterized in that the first end wall centrally includes a baffle knob protruding towards the inlet pipe. This provides for improved control of the inflowing feed when it changes from being an axial flow to being a radial flow by preventing such a sudden change in direction.

In a further embodiment the baffle knob may have radial ribs uniformly distributed along the periphery of the baffle knob. The ribs may extend along straight lines or helical lines. This may be necessary in order to impart a sufficient rotation to the feed in the inlet with the view of obtaining a stable circulation flow in the inlet.

In other embodiments the inlet may be provided in an exchangeable part of the conveyor body and the baffle knob may be exchangeably secured to the first end wall and the projection containing the axial bore of the inlet pipe may be exchangeably secured to the second end wall. It is obtained by these measures that one and the same decanter centrifuge may be used for various types of feed, in that one or more of said components is/are exchanged.

In a preferred embodiment of the decanter centrifuge according to the invention the inlet pipe may be axially displaceable. It is thus obtained that the diameter of the Jet at the baffle knob may be altered by displacement of the inlet pipe, thereby making it possible to adapt the flow in the inlet to the type of feed and/or the rate of flow thereof.

BRIEF DESCRIPTION OF THE DRAWINGS

The invention will now be explained in detail by some embodiments and with reference to the drawings, in which FIG. 1 in a very schematical form shows a section of a decanter centrifuge according to the invention.

DETAILED DESCRIPTION OF THE PREFERRED EMBODIMENTS

Figure 1:
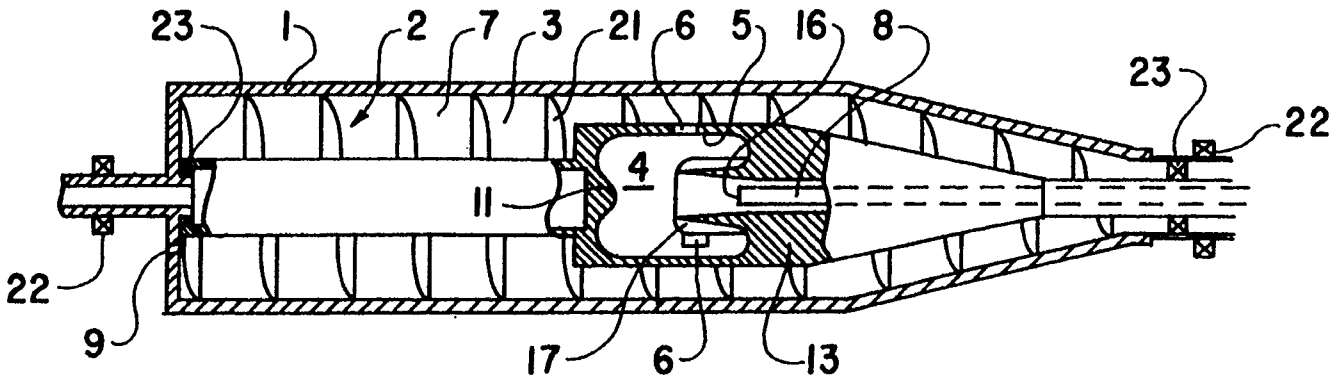

The decanter centrifuge illustrated in FIG. 1 includes a drum 1, rotatably Journalled in bearings 22 at each end. A conveyor 2 is rotatably Journalled in drum 1 in relation to the drum by means of bearings 23 at each end. Conveyor 2 comprises a conveyor body 3 with an external helical flight 21. The conveyor body 3 includes an inlet 4 axially defined by a first end wall 11 and a second end wall 13. Inlet 4 is radially defined by a wall 5 that is coaxial with the conveyor body 3 and comprises inlet apertures 6 connecting the inlet 4 with the space 7 between the conveyor body 3 and the internal side of drum 1. The decanter centrifuge further includes an inlet pipe 8 having a mouth 16 directed towards inlet 4.

Figure 2:
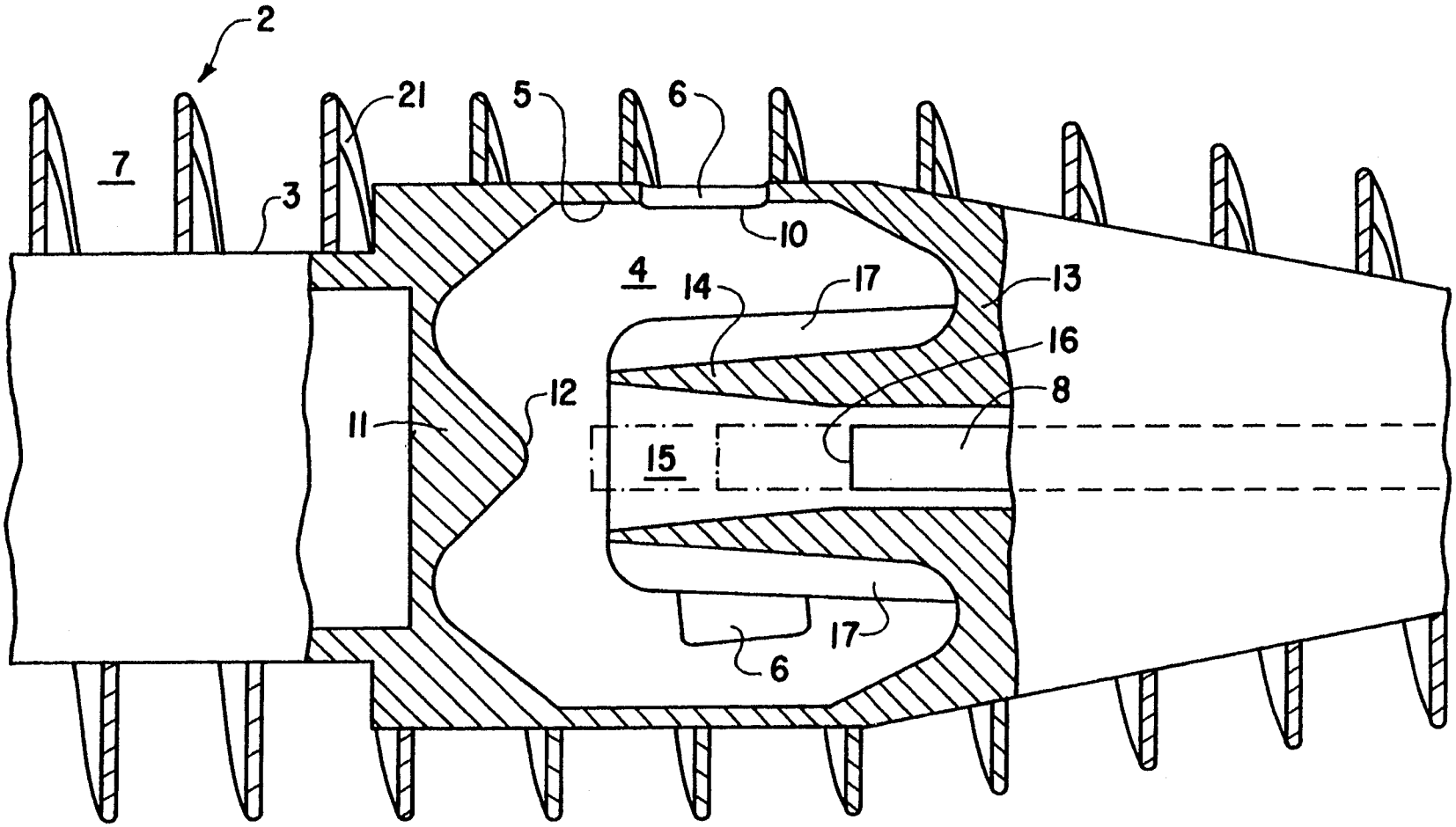
FIG. 2 shows an embodiment of the inlet of a decanter centrifuge, as illustrated in FIG. 1.

FIG. 2 illustrates inlet 4 with the end wall 11 having centrally a baffle knob 12, in this embodiment shaped as an approximately spherical face smoothly merging into end wall 11 which per se constitutes a smooth transition to the radially confining wall 5. Opposite the baffle knob the second end wall 13 has a projection 14 which includes a bore 15 for inlet pipe 8 and is coaxial with the drum axis. Projection 14 has the shape of a truncated cone whose small end faces the baffle knob. At the large end projection 14 merges smoothly into end wall 13 which per se merges smoothly into wall 5. Six, substantially radial, slightly helical, longitudinal ribs 17 uniformly distributed along the periphery of the projection are positioned on the periphery of projection 14. The mouth of inlet pipe 8 is situated in a plane perpendicular to the drum axis. Inlet pipe 8 is axially displaceable, thereby allowing the distance between mouth 16 and baffle knob 12 to be varied. The adjustment of this distance may according to choice be effected during operation and the variation of the distance may be effected manually or automatically by means of a control mechanism, not shown.

The radial wall 5 is provided with inlet apertures 6 all of which are positioned between the helical flight 21. The apertures are provided uniformly across the entire axial extension of wall 5. The liquid may then flow freely from the inlet through the inlet apertures into space 7 without passing members capable of provoking turbulence and vortices.

Figure 3:
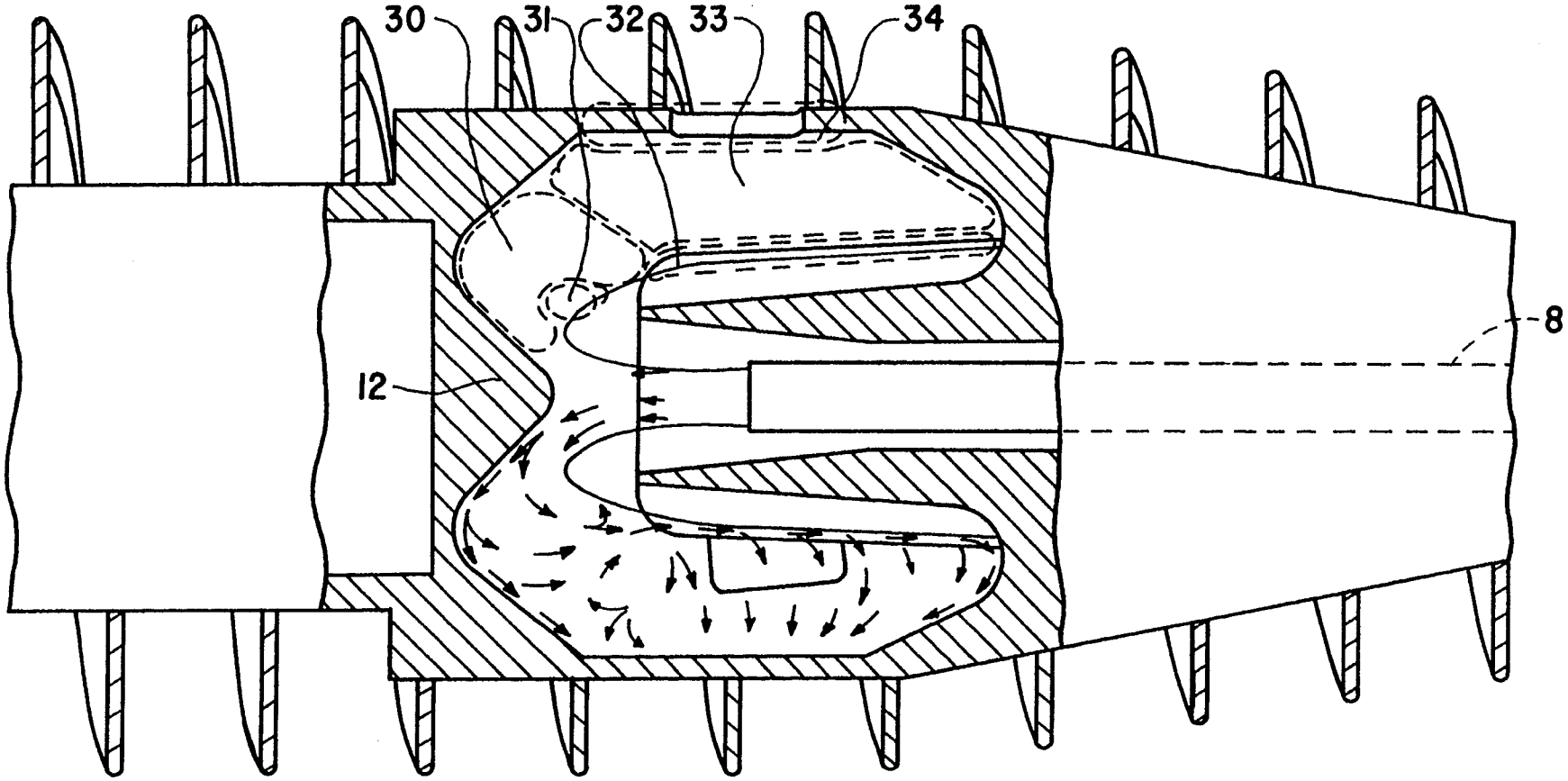
FIG. 3 shows an inlet as in FIG. 2, in which the path of the flow in the feed in the inlet is indicated.

FIG. 3 illustrates the flow paths in the inlet. In dashed lines the upper half of the figure shows various characteristic flow areas through which the feed flows when passing the inlet.

Arrows in the lower half of the figure show the direction of the non-tangential velocities of the feed in the inlet.

The path of the feed through the inlet may be described as follows. The feed leaves inlet pipe 8 and continues in a Jet towards baffle knob 12 at which it is radially dispersed between the baffle knob and a vortex area 31 located at the free liquid surface. The feed subsequently passes into an agitation zone 30 in which a mixing is effected with liquid from a radially external area 33 of the inlet, thereby increasing the angular velocity of the feed. Said angular velocity is somewhat smaller than the angular velocity in the adjacent zone 33, the so-called dissipation area, and the feed will therefore be forced back towards the liquid surface in the direction towards the radial outer edges of ribs 17. In view of the fact that the ribs rotate with the same speed as the conveyor body, an angular acceleration is imparted to the liquid in this area preventing the liquid from penetrating further towards projection 14. The ribs are slightly helical, thereby forcing the liquid towards end wall 13. In the area of acceleration 32 the feed attains the same angular velocity as the ribs whereas the excess energy brought about by this acceleration occurs as a radial velocity carrying the feed into the disspipation area 33 throughout the length of projection 14.

The turbulent flow in the dissipation area 33 converts the radial velocity to a temperature rise in the feed and a mixing takes place so that the high angular velocity in the liquid coming from ribs 17 is converted to an average angular velocity in the liquid moving radially towards area 34 surrounding inlet apertures 6. The three inlet apertures 6 are positioned between the flights so that there are no edges capable of imparting tubulence or retaining threads or similar bigger particles in the feed. The apertures are so large that they do not form any restriction to the flow and as they follow the flights they are axially displaced in relation to each other and cover almost the entire length of the circularly cylindrical wall 5. By the passage of one of the inlet apertures the feed is imparted a small supplementary acceleration, but this influence is only slight because the feed already has obtained approximately the same angular velocity as the conveyor body on said location.

The figure shows that the end walls 11 and 13 merge smoothly into the circularly cylindrical wall 5. This is not a necessary prerequisite in order that the inlet functions as explained above. If the transition between the end walls and the circularly cylindrical wall were designed as a right-angled corner a stationary flow would just be created in this corner and would not interfere with the above mentioned flows. In such a case it would be possible that a sediment from the feed would precipitate on the actual spot, and this might necessitate a cleaning of the inlet after some time in operation. In order to avoid this, the various faces of the inlet should merge smoothly into each other.

Figure 4:
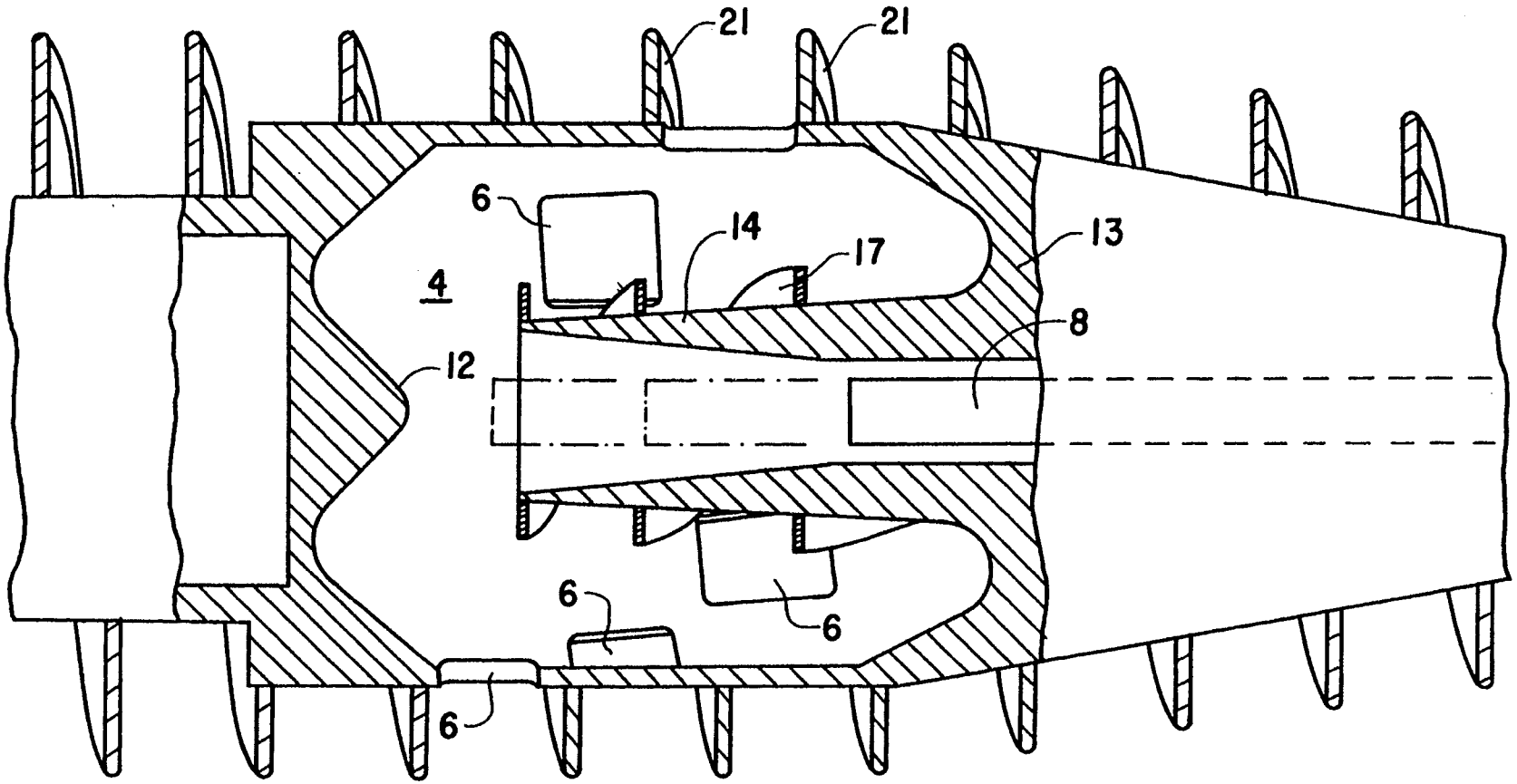
FIG. 4 shows an inlet as in FIG. 3, in which the projection of the second end wall has two ribs following helices along the periphery of the projection.

The inlet illustrated in FIG. 4 has ribs 17 that are helically positioned along the circumference of projection 14. Such ribs provoke a stronger flow in the area of acceleration 32 towards end wall 13 than the ribs 17 shown in FIG. 3. Six inlet apertures 6 all of which are positioned between the screw flights 21 are provided in this latter embodiment of the inlet.

Figure 5:
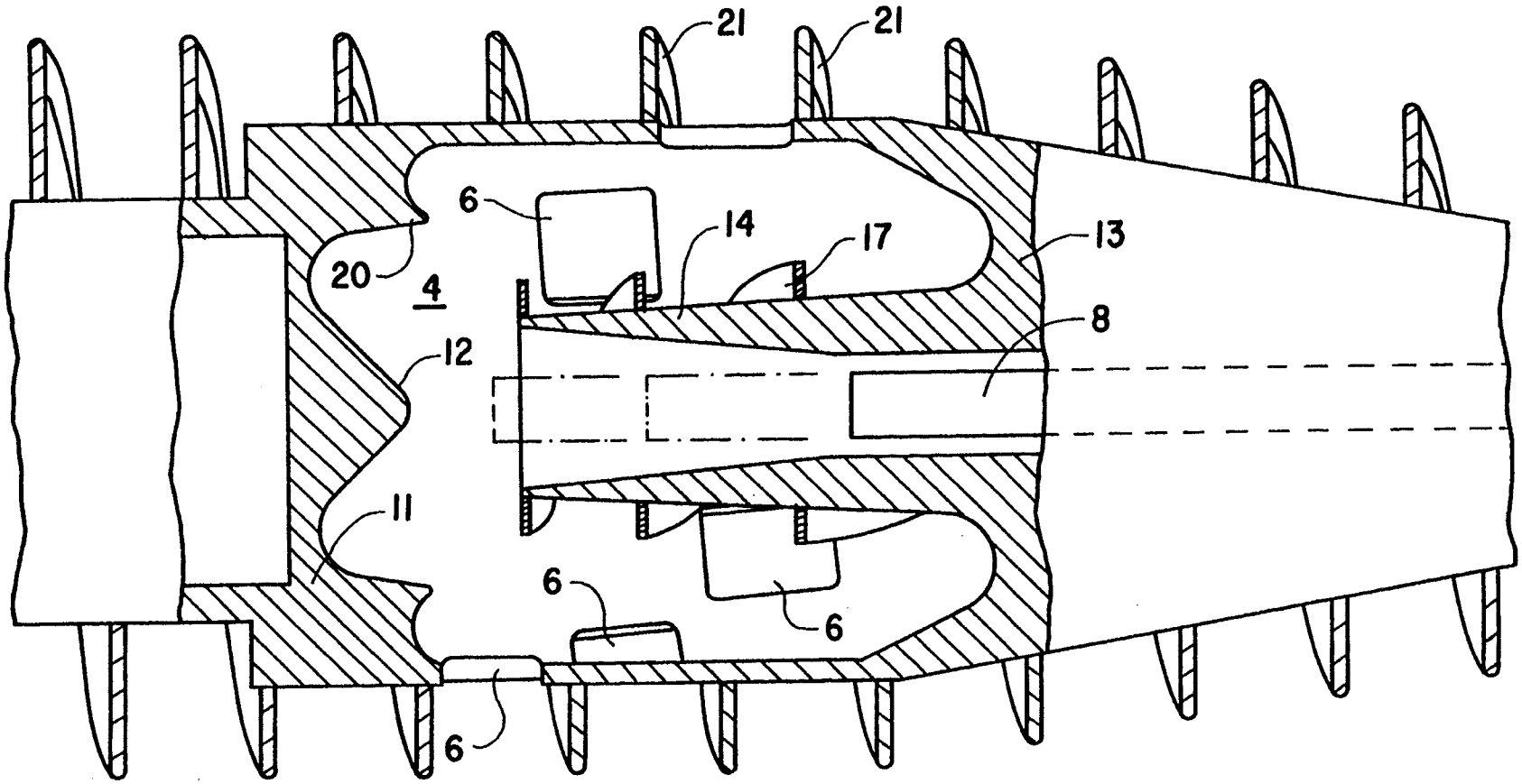
FIG. 5 shows an inlet as in FIG. 4, in which the first end wall has an annular projection.

The inlet illustrated in FIG. 5 has an end wall 11 with an angular projection 20 which on the radially internal and external side of the projection merges smoothly into end wall 11. With such a projection it is possible to obtain strong control of the flow path in the inlet and by comparison with the upper half of FIG. 3 it is apparent that the projection divides the agitation zone from the dissipation zone, thereby forcing the feed to flow through a longer distance, thereby disspitating its energy prior to approaching the inlet area 34.

Figure 6:
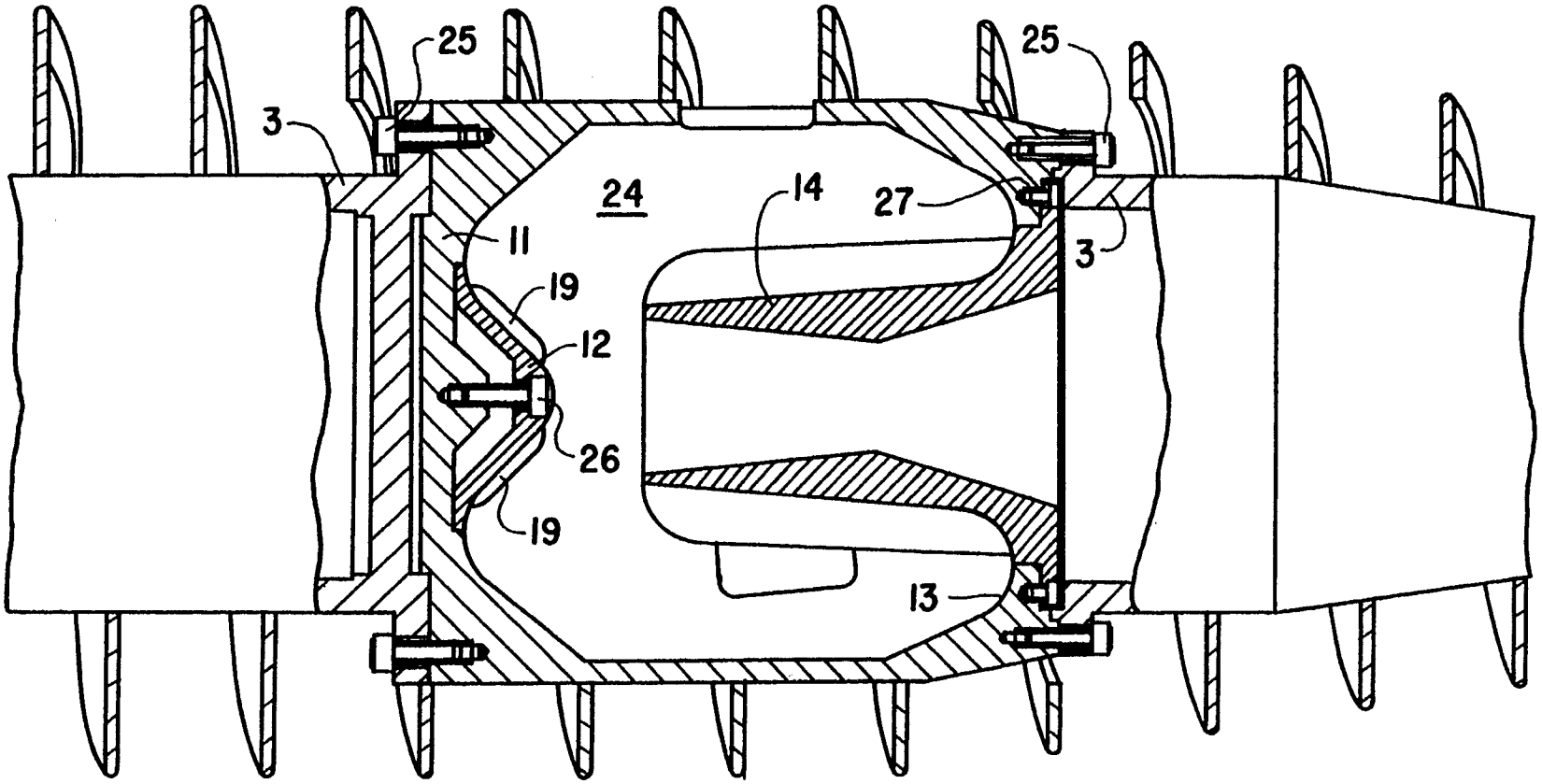
FIG. 6 shows an inlet as in FIG. 2, in which the inlet, the baffle knob and the projection of the second end wall are exchangeably mounted.

FIG. 6 illustrates an inlet substantially designed as the inlet in FIG. 2, but the inlet portion itself is designed as a separate component joined with conveyor body 3 by bolts 25 and flanges on the conveyor body. Baffle knob 12 is also designed as a separate component fixedly bolted on end wall 11 by means of a central bolt 28. Projection 14 is likewise designed as a separate component which through bolts 27 is fixedly bolted on end wall 13.

By the adaptation of a decanter centrifuge according to the invention to a specific form of operation, the described inlet offers great possibilities of varying the size and the shape of the various members in order to obtain an optimum yield. The radius of the inlet may be altered only within narrow limits, but it is possible to extend the inlet in the axial direction. In this respect, it must be taken into account that an extension of the inlet generally implies that projection 14 has to be extended too, because it is necessary to control the internal surface of the liquid in the inlet in order to ensure that it does not penetrate so far towards the axis of rotation that the liquid discharges through bore 15 in the projection. If the inlet apertures 6 of a long inlet are uniformly distributed throughout wall 5, there is a risk that part of the feed will only have a short path through the inlet before passing an inlet aperture and penetrating into space 7. In such a case it may be advantageously to make use of an end wall 11 with an annular projection 20, as illustrated in FIG. 5.

The function of ribs 17 throughout a large span of flow rates is to prevent overflow through bore 5, to impart angular velocity to the feed and to distribute the feed axially throughout the entire inlet, thereby enabling excess energy originating from the acceleration to dissipate throughout the entire dissipation area 33 of the inlet. The axial extension of ribs 17 must therefore be adapted to the axial length of the inlet. The ribs 17 should, however, cover the area at the inlet apertures. Radially the ribs must be positioned on the smallest possible radius, in respect of the diameter of the inlet pipe and also of the bore 15, and the length and also the strength of projection 14.

Figure 7:
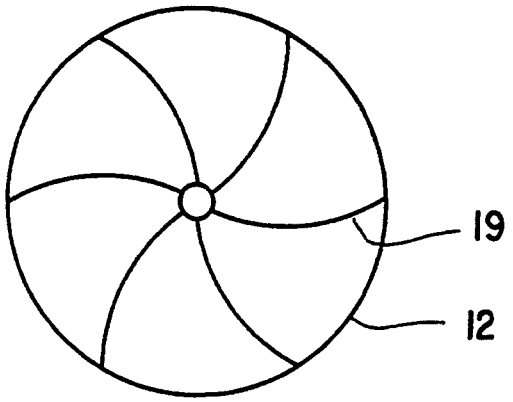
FIG. 7 is a schematical view of a baffle knob with retilinear ribs.
Figure 8:
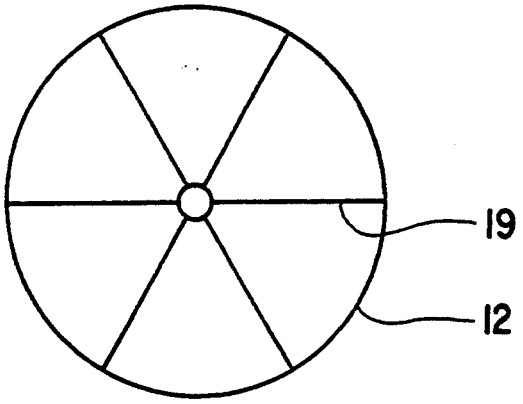
FIG. 8 is a schematical view of a baffle knob with helical ribs.

The individual rib may extend completely axially, at a constant angle in relation to the axis of rotation or at a variable angle in relation to the axis. The angle in relation to the axis is selected based on the axial distribution of the feed throughout the dissipation area 33 and must be adapted to the rate of flow, the type of feed to be separated and the axial extension of ribs 17 and inlet 4, as mentioned above. The ribs are designed so that hair and threads in the feed do not settle and cling to edges but are thrown off. The purpose of the baffle knob is to alter the direction of the feed so that it is carried into the agitation area 30 with a minimum interference with the free surface of the feed in the inlet and so as to obtain a uniform distribution across the surface of end wall 11. If ribs 17 on projection 14 do not result in the desired rotation there may, as illustrated in FIG. 6, be provided radial ribs 19 uniformly distributed along the periphery of the baffle knob and following straight lines, as shown in FIG. 7, or helices, as shown in FIG. 8. Said ribs should likewise be shaped so that hair and threads do not settle.

By passing through inlet apertures 6 into space 7, a small acceleration is imparted to the feed, as mentioned above. In order to reduce this supplemental acceleration, it is advantageous that the thickness of material in the area at the inlet apertures is as small as allowed by the considerations relating to strength and wear.

In respect of the fact that the inlet apertures are located beneath the free surface of the liquid in the inlet, only very small quantities of air may discharge through the inlet. This is the reason why the projection, as mentioned above, is advantageously given the form of a truncated cone, whereby possible air in the inlet may be carried back along the inlet pipe.

In decanter centrifuges having rotating inlet pipes journalled within the conveyor body, means of ensuring that the inlet may be vented through the bearing should be provided. In such a decanter centrifuge it is possible to further improve the separation by establishing partial vacuum in the inlet by exhaustion. Such a partial vacuum reduces the energy to be dissipated, some of the excess energy being in this case used to compensate for the partial pressure.

I claim:

1. A decanter centrifuge comprising:

a rotatably journalled drum having outlet openings at one end thereof through which separated liquid can exit;

a conveyor rotatably journalled in said drum, said conveyor having a substantially cylindrical body having a longitudinal axis with a plurality of flights along said longitudinal axis, and said conveyor further having an inlet, said inlet having a side wall coaxial with said body, a rotationally symmetrical first end wall and a second end wall located opposite the first end wall so that said side wall, first end wall and second end wall form a cavity within said inlet for feed to be separated, wherein said side wall is provided with inlet apertures located between two adjacent flights of said conveyor for connecting the inlet with a space located between said body and the drum, said second end wall having a central projection extending towards said first end wall, said projection having an axial bore formed therein for receiving an inlet pipe for the feed, said inlet pipe being coaxial with said body and having a mouth facing said inlet; and wherein said inlet apertures are disposed radially further from said longitudinal axis than said outlet openings, wherein at least a portion of said side wall adjacent said inlet apertures and an outer peripheral portion of said first end wall are substantially smooth and free of any projections, and wherein said central projection is frusto-conical in shape with a narrow end opposing said first end wall, so that turbulence in said space is inhibited.

2. A decanter centrifuge as in claim 1, wherein an outer periphery of said central projection has a helical rib extending radially therefrom.

3. A decanter centrifuge as in claim 1, wherein an outer periphery of said central projection has a plurality of ribs extending radially therefrom, said ribs following a helical pattern about said central projection.

4. A decanter centrifuge as in claim 1, wherein an outer periphery of said central projection has a plurality of longitudinal ribs extending radially therefrom, said ribs being uniformly distributed about said central projection.

5. A decanter centrifuge as in claim 1, wherein said first end wall is centrally provided with a baffle knob protruding towards said inlet pipe.

6. A decanter centrifuge as in claim 5, wherein said baffle knob has a plurality of ribs extending radially therefrom, said ribs being uniformly distributed about said baffle knob.

7. A decanter centrifuge as in claim 6, wherein said ribs follow a helical pattern about said baffle knob.

8. A decanter centrifuge as in claim 5, wherein said baffle knob is removeably attached to said first end wall.

9. A decanter centrifuge as in claim 1, wherein said first end wall has an annular projection opposing said inlet pipe.

10. A decanter centrifuge as in claim 1, wherein said inlet is removably attached to said conveyor body.

11. A decanter centrifuge as in claim 1, wherein said central projection is removably attached to said second end wall.

12. A decanter centrifuge as in claim 1, wherein said inlet pipe is axially displaceable.

* * * * *